US006264079B1

(12) United States Patent
Skaggs

(10) Patent No.: US 6,264,079 B1
(45) Date of Patent: Jul. 24, 2001

(54) SIZE-ADJUSTABLE CONCEALED CARRY HOLSTER

(76) Inventor: Jess O. Skaggs, 1912 Twin Oaks, Kingsland, TX (US) 78639

( * ) Notice: Subject to any disclaimer, the term of this patent is extended or adjusted under 35 U.S.C. 154(b) by 0 days.

(21) Appl. No.: 09/606,078

(22) Filed: Jun. 29, 2000

Related U.S. Application Data

(60) Provisional application No. 60/142,387, filed on Jul. 6, 1999.

(51) Int. Cl.[7] ..... F41C 33/02

(52) U.S. Cl. ..... 224/193; D3/222; 224/666; 224/668; 224/676; 224/911

(58) Field of Search ..... 224/192, 193, 224/666, 676, 668, 911; D3/222, 223

(56) References Cited

U.S. PATENT DOCUMENTS

| | | | | |
|---|---|---|---|---|
| D. 292,751 | | 11/1987 | Remington . | |
| D. 358,705 | | 5/1995 | Saggese, Jr. . | |
| 3,008,617 | | 11/1961 | Villwock . | |
| 4,205,768 | * | 6/1980 | Hill et al. | 224/193 |
| 4,544,089 | * | 10/1985 | Tabler | 224/192 |
| 4,644,676 | | 2/1987 | Stern . | |
| 4,787,540 | * | 11/1988 | Barry | 224/192 |
| 4,846,383 | | 7/1989 | Gallagher . | |
| 4,848,625 | | 7/1989 | Lucia . | |
| 4,881,684 | | 11/1989 | Chinman . | |
| 4,966,320 | | 10/1990 | DeSantis et al. . | |
| 4,966,321 | | 10/1990 | Outlaw . | |
| 5,201,447 | | 4/1993 | Bumb . | |
| 5,692,237 | | 12/1997 | Bennett . | |
| 5,727,341 | | 3/1998 | Saylor . | |
| 5,875,944 | * | 3/1999 | Beletsky | 224/911 |
| 5,931,358 | * | 8/1999 | Rogers | 224/911 |

FOREIGN PATENT DOCUMENTS

| | | |
|---|---|---|
| 128476 | 6/1919 | (GB) . |
| 913758 | 12/1962 | (GB) . |

* cited by examiner

*Primary Examiner*—Stephen P. Garbe
(74) *Attorney, Agent, or Firm*—Richard C. Litman

(57) ABSTRACT

A size-adjustable holster for carrying a wide variety of handguns in a wide variety of carry positions. The holster's body has a flat sheet with corresponding hook and loop fasteners on each side, allowing it to wrap snugly around almost any pistol. A clip is attached to the body for securing the holster to the wearer's clothing. The holster may be used by right handed or left handed individuals, for vertical or grip-forward carry. The holster may be worn inside the waistband, on the belt or waistband, inside a boot, or inside a jacket pocket.

19 Claims, 9 Drawing Sheets

SIZE-ADJUSTABLE CONCEALED CARRY HOLSTER

CROSS-REFERENCE TO RELATED APPLICATION

This application claims the benefit of U.S. Provisional Patent Application Ser. No. 60/142,387, filed Jul. 6, 1999.

BACKGROUND OF THE INVENTION

1. Field of the Invention

The present invention is a holster for a handgun and, more specifically, a holster including a size-adjustable pocket and a clip for securing the holster to the wearer's clothing.

2. Description of Related Art

Holsters intended for discreetly carrying a defensive handgun have been in existence since guns were first made small enough for concealed carry. Today, such holsters are used both by plainclothes or off duty police officers and by an increasing number of private citizens who have felt a need to take precautions to ensure their safety.

Most people who carry a handgun prefer to carry it at belt level, positioned on or slightly behind the strong side hip. A few prefer to carry the gun on or slightly in front of the weak side hip, commonly known as crossdraw carry.

One of the most popular styles of concealment holsters is the inside waistband holster. Such holsters are worn inside the waistband of the wearer's pants, slightly behind the strong side hip, with only the upper lip of the holster and grip of the gun protruding from the pants. A belt clip or loop secures the holster to the wearer's belt. The top of the holster is covered by a jacket, sweater, or untucked shirt. This type of holster is especially popular with police, because the draw from this type of holster is very similar to the draw from a duty holster, providing for simplified training and practice.

To be truly useful, such a holster must be able to perform several functions well. First, it must be easily concealed to avoid unnecessarily alarming casual observers, which is accomplished in part by keeping the thickness of the holster's leather to a minimum. Second, it must be comfortable to wear for long periods of time. Third, it must hold the gun securely in place. Fourth, it must provide quick access to the gun so that the wearer can respond properly to unexpected emergencies. All of the above functions are most easily accomplished when the holster is properly fitted to the gun to be carried.

Current holsters are generally one of two types: those precisely molded to the gun they are intended to carry, and those intended to fit any gun within a certain size range. The first category generally works very well, but is expensive and only available for the more popular types of handguns. The second generally uses a nonadjustable pocket with an adjustable safety strap, which works well only for a narrow size range. If the selected handgun is a less common type, such as a derringer, neither type of holster may be available. If one of several different handguns is selected, the need for at least one holster per handgun results in a large expense.

In addition to the above types of holsters, several others have been proposed, as described below. However, the present inventor is aware of no other holster which is useable both with a wide variety of guns and, equally importantly, in a wide variety of carry positions.

U.S. Pat. No. 3,008,617, issued to W. A. Villwock on Nov. 14, 1961, describes a holster having a front seam secured with magnets, and with snap fasteners. When the need for a fast draw is foreseen, the snap fasteners are unfastened, so that the gun can be drawn through the magnets.

U.S. Pat. No. 4,644,676, issued to Michael A. Stern on Feb. 24, 1987, describes a firearm safety apparatus. The firearm safety apparatus is an elastic band fitting over the trigger guard and breech of a gun.

U.S. Pat. No. 4,846,383, issued to Richard N. Gallagher on Jul. 11, 1989, describes a holster having a flexible spine for snugly accommodating a handgun from a selected range of sizes.

U.S. Pat. No. 4,848,625, issued to Peter W. Lucia on Jul. 18, 1989, describes a vacuum bottle holder. The vacuum bottle holder includes a resilient open cylindrical band and a belt loop, and may include a bottom strut for supporting the bottom of the bottle.

U.S. Pat. No. 4,881,684, issued to Carole Chinman on Nov. 21, 1989, describes a wrapper for articles having a central area with a plurality of wing sections.

U.S. Pat. No. 4,966,320, issued to Eugene DeSantis et al. on Oct. 30. 1990, describes a simulated pouch with an interior concealed holster. The holster is reversibly mounted within the pouch with hook and loop fasteners.

U.S. Pat. No. 4,966,321, issued to Wade S. Outlaw on Oct. 30, 1990, describes an adjustable holster for pistol type power tools. The holster includes a flexible sheet material having an upper and lower adjustable strap, secured with hook and loop material so that it forms a loop around the sheet material. The holster also includes a pair of belt loops.

U.S. Pat. No. 5,201,447, issued to George Bumb et al. on Apr. 13, 1993, describes a quick release holster having a U-shaped retainer for carrying on a belt, and a pair of flexible straps for securing a pistol. The straps connect to the holster by hook and loop fasteners, and to each other by snaps.

U.S. Pat. No. 5,692,237, issued to Richard G. Bennett on Dec. 2, 1997, describes a weapon concealment system. The concealment system is a garment such as a jacket having a panel joined to its inside front along one edge, forming a hinged joint. The panel conceals a holster secured to the jacket by hook and loop fasteners.

U.S. Pat. No. 5,727,341, issued to Daniel A. Saylor on Mar. 17, 1998, describes a boot holster.

U.K. Pat. No. 128,476, published on Jun. 26, 1919, describes a holster having a belt loop stitched to the top flap, so that, when the top flap is released, the weight of the gun pulls the holster downward, pulling the flap upward.

U.K. Pat. No. 913,758, published on Dec. 28, 1962, describes a holster. The holster is made by folding the sides of the blank so that they overlap the center of the blank, and then securing the sides together.

United States design patents related to holsters include U.S. Pat. No. Des. 292,751, issued to Robert W. Remington on Nov. 17, 1987, showing a combined assault pistol holster and belt; and U.S. Pat. No. Des. 358,705, issued to Nicholas R. Saggese, Jr. on May 30, 1995, showing an ankle wallet.

None of the above inventions and patents, taken either singly or in combination, is seen to describe the instant invention as claimed.

SUMMARY OF THE INVENTION

The invention is a size-adjustable holster for use with a wide variety of handguns in a wide variety of carry positions. The holster is made from an elongated, five-sided sheet, corresponding hook and loop fasteners at each end of the sheet, a clip, and a clip-securing panel.

The five-sided sheet forming the holster pocket has the approximate configuration of a rectangle with an eccentric point at one end. The pointed end includes one component of the hook and loop fasteners preferably on its inside surface, and preferably the hooks. The squared end includes the corresponding component, preferably on its outside surface, and preferably the loops. When the mating hook and loop components are brought together, the result is a tapered pocket with a wide top opening and narrow bottom opening. One side of the pocket is vertical, and the other is angled. The pocket is preferably made from leather, but may be made of other materials such as nylon.

A stiff, flexible clip is attached to the central portion of the pocket. The clip is U-shaped, with the closed end near the wide top opening of the pocket, and the open end oriented towards the narrow bottom opening of the pocket. Each side of the open end includes an inward-curved bearing surface, with each inward-curved surface facing the opposing inward curved surface.

The clip is attached to the belt by a clip-securing panel. The clip-securing panel is rectangular, and has a pair of horizontal slots. One end of the clip is inserted through the top slot, so that the top slot is positioned adjacent to the closed end of the clip. The innermost bearing surface will then protrude through he bottom opening, securing the clip and clip securing panel together, and allowing the corresponding bearing surfaces to abut each other. The clip securing panel is then stitched to the body of the holster.

The holster may be used with a wide variety of handguns. By placing the handgun in the holster with the hook and loop fasteners separated, and then securing the hook and loop fasteners together, the wearer will have a holster sized to a specific gun. The open bottom allows use of any reasonable barrel length. The taper allows the trigger guard to pass through the wide top opening, but not the narrow bottom opening. The holster may be used with a wide variety of handguns, including most revolvers and semi-automatics, and was conceived particularly for derringers, for which other holsters are largely unavailable.

The holster may be worn in several different positions by both right and left handed people. By inserting the gun with the trigger guard adjacent to the tapered side, the gun will be carried vertically as long as the clip is attached vertically. By inserting the gun with the trigger guard adjacent to the vertical side, the gun will be carried grip-forward. Clipping the clip to the wearer's clothing at an angle will change the angle at which the gun is carried.

The holster may be carried in any of several different positions. A preferred and suggested position is inside tile waistband, which, because of the clip, may be done without a belt. The holster may alternatively be clipped to the outside of a waistband, the inside of a boot, or inside a jacket pocket.

Accordingly, it is a principal object of the invention to provide a size-adjustable holster fitting a wide variety of handguns.

It is another object of the invention to provide a size-adjustable holster useable by right and left handed users.

It is a further object of the invention to provide a size-adjustable holster useable in a wide variety of carry positions.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 4:
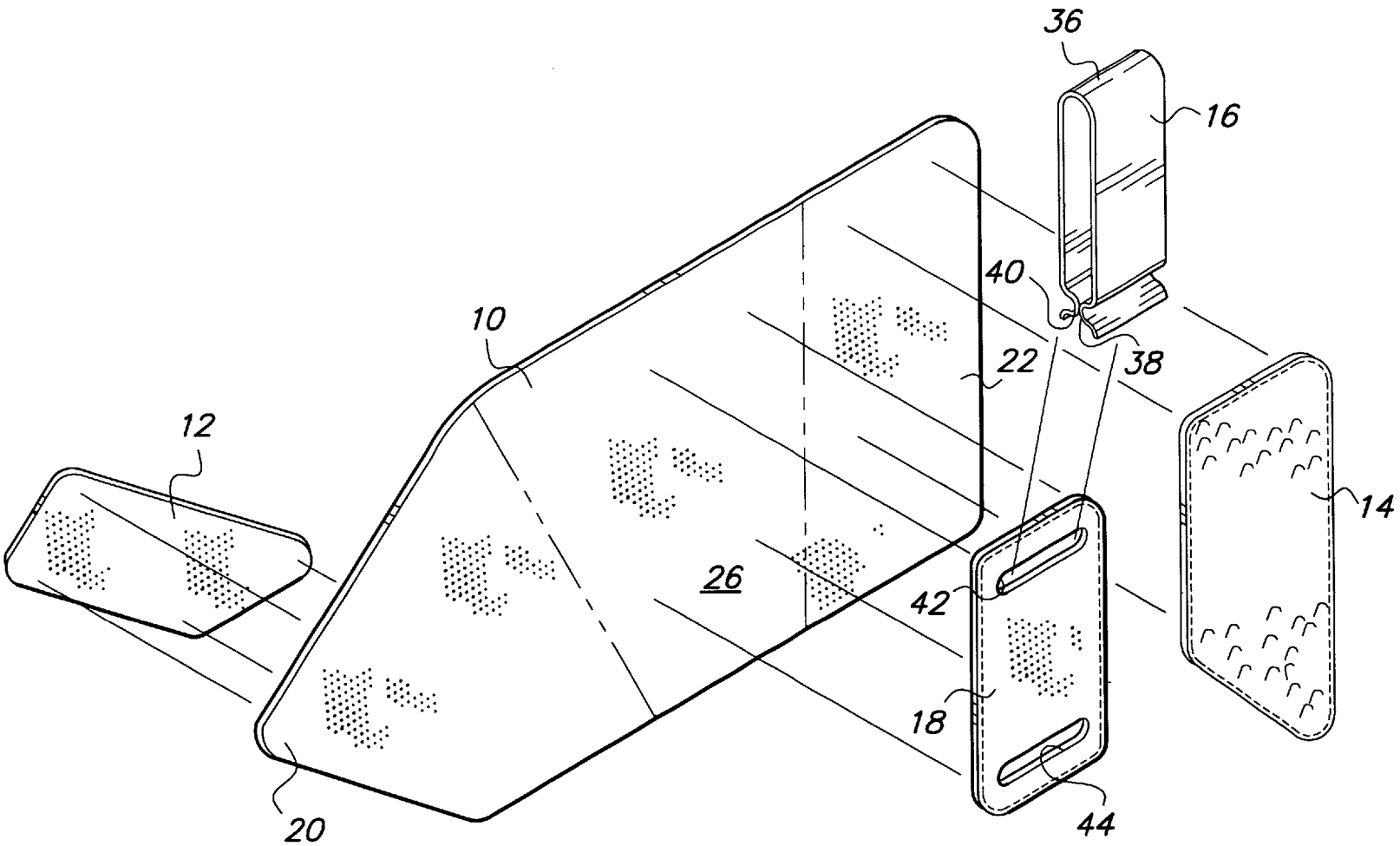
FIG. 4 is an exploded view of a size-adjustable concealed carry holster according to the present invention.

The present invention is a size-adjustable holster H made up of five basic elements, best seen in and appreciated from FIG. 4. These are: a five-sided sheet 10; a hook fastener 12; a complementary loop fastener 14; a clip 16; and a clip-securing panel 18. The sheet 10 is five-sided in planar configuration, so as to have an eccentric, somewhat pointed end 20 and an opposed, vertical side 22. The sheet 10 is, in a preferred embodiment, made of leather, but could be manufactured from nylon or other materials known to a routineer in the holster manufacturing arts.

Figure 2:
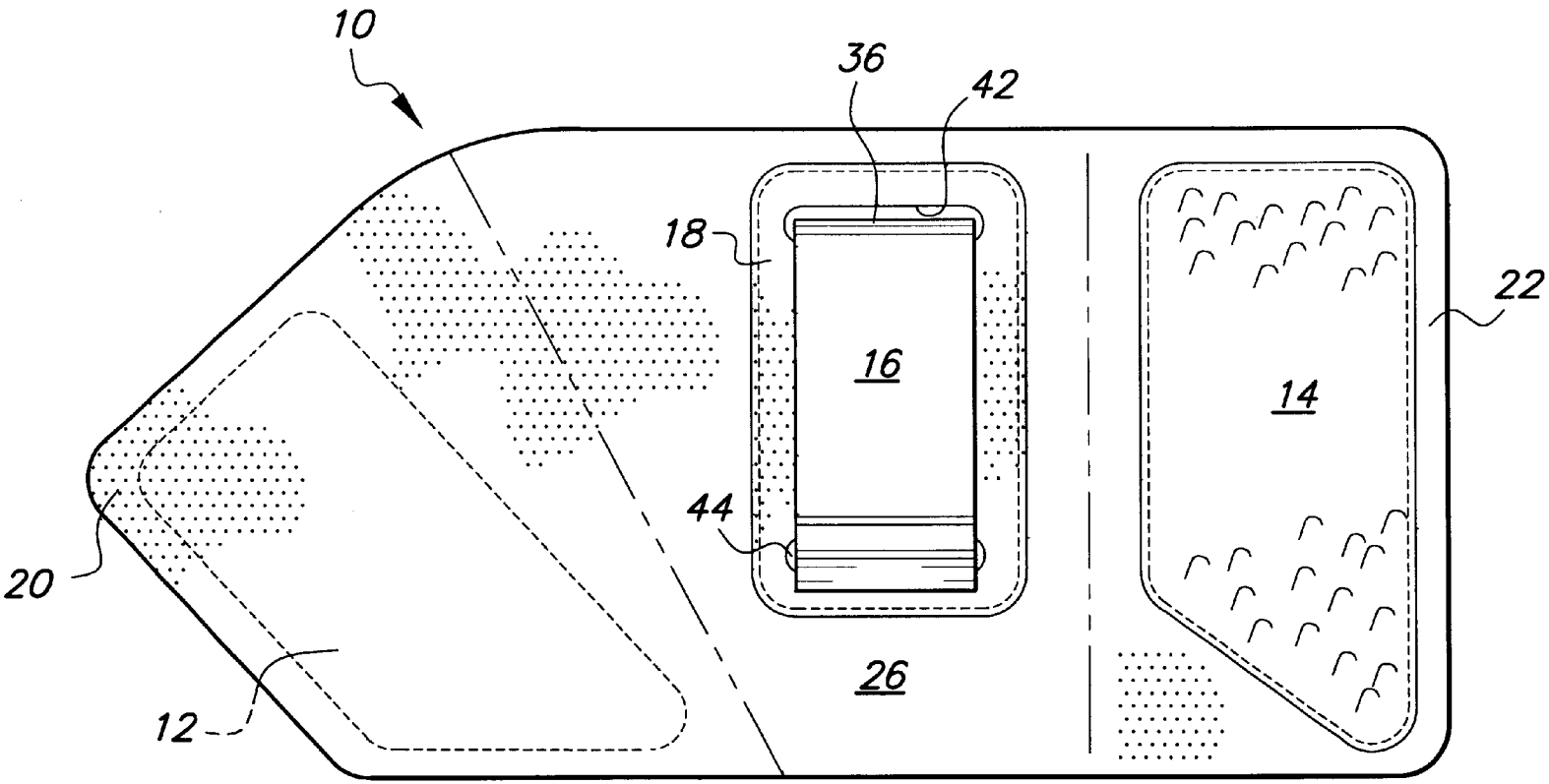
FIG. 2 is a side view of a size-adjustable concealed carry holster according to the present invention, showing the outside of the holster.
Figure 3:
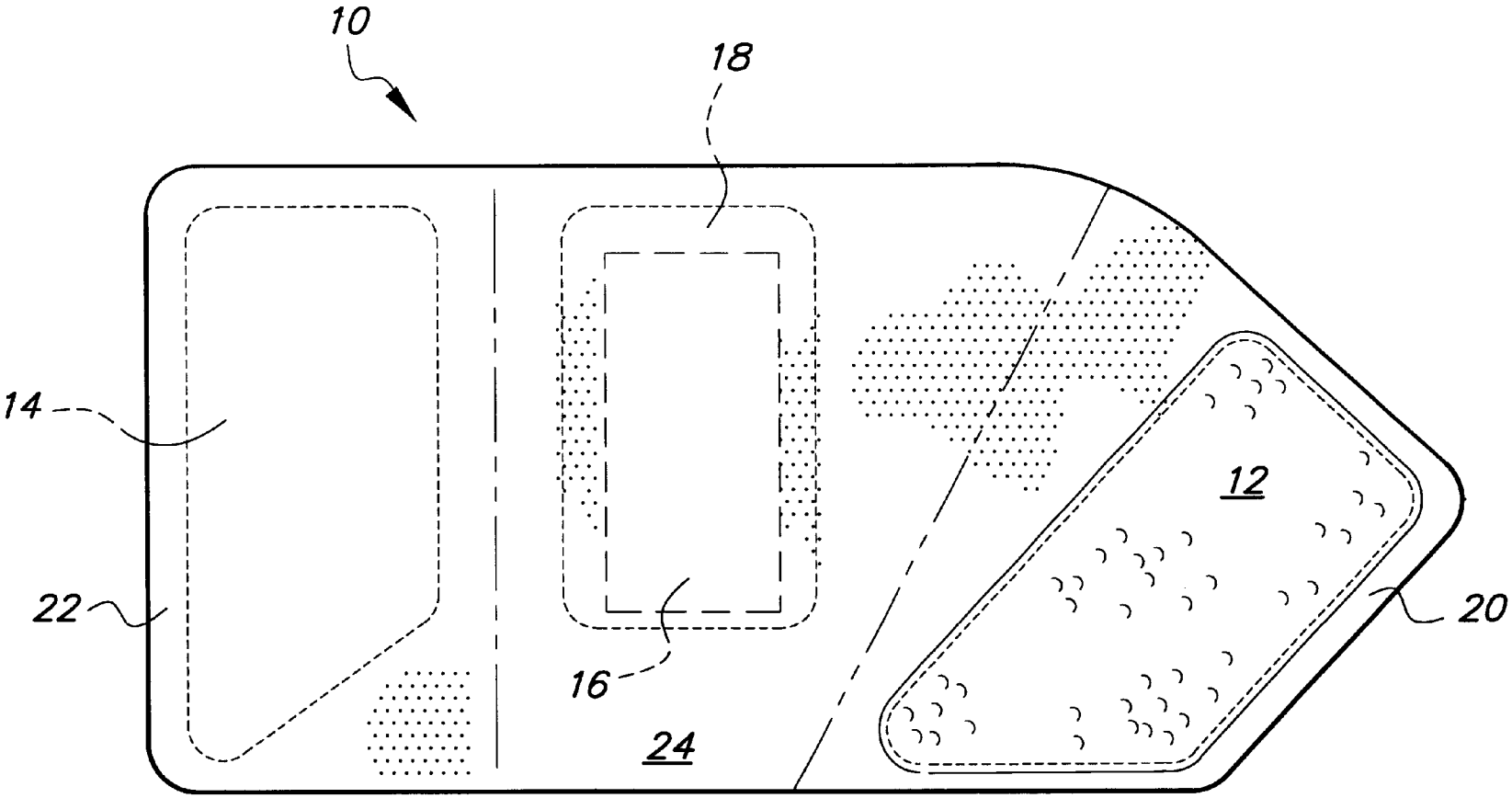
FIG. 3 is a side view of a size-adjustable concealed carry holster according to the present invention, showing the inside of the holster.

With reference to FIGS. 2, 3 and 4, preferably the hook fastener 12 is attached to the inside surface 24 (FIG. 3), at the pointed end 12, and the loop fastener 14 is attached to the outside surface 26 (FIG. 2), at the vertical side 22. The fasteners 12, 14 may be secured to the sheet 10 by any suitable means, such as the peripheral stitching shown. The placement of fasteners 12, 14 could be reversed and still be within the ambit of this invention.

Figure 1:
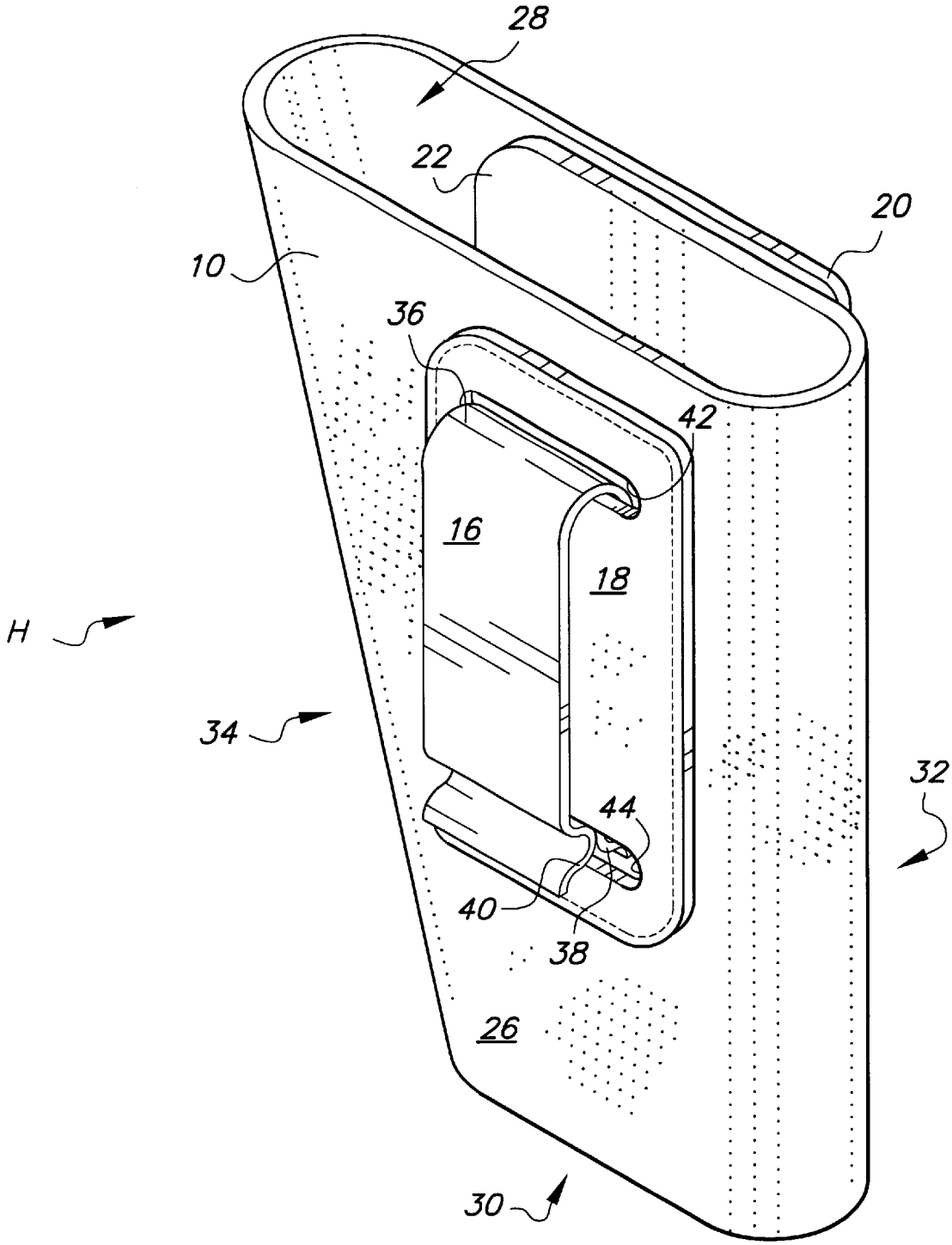
FIG. 1 is a perspective view of a size-adjustable concealed carry holster according to the present invention.

Thus, when the mating fasteners 12, 14 are brought together, the result is a tapered pocket forming the holster, best seen in FIG. 1, with a wide, top opening 28, and a narrower, bottom opening 30. One side 32 of the holster is vertical, while the other side 34 of the holster is angled.

Referring further to FIGS. 1,2 and 4, the stiff, flexible clip 16 is attached to a central portion of the sheet 10, and is of generally inverted U-configuration, with a closed web 36 near top 28 of the holster, and an open end directed toward the bottom 30 of the holster. The open end of clip 16 is defined by opposed, curved elements 38, 40, providing bearing surfaces, with the surfaces 38, touching or abutting one another when the clip 16 is a normal, unflexed attitude, shown in FIG. 1. Preferably, clip 16 is made of a suitable memory-retentive material such as spring steel; other metals or plastics could be used.

Clip 16 is attached to the holster by clip securing panel 18, which is attached to the central portion of sheet 10 by peripheral stitching as shown or by other suitable means. A pair of horizontal slots 42, 44 are formed through panel 18, for secure attachment of clip 16 to panel 18. A selected arm of clip 16 is inserted through top slot 42 and lowered, so that web 36 of clip 16 is at the top and bearing surfaces 38, 40 abut one another through the bottom slot 44. This would be done in the manufacturing process, preferably before panel 18 is stitched to sheet 10, to assure that the clip 16 is trapped within the panel 18. With especial reference to FIG. 4, it will be noted that there are no slots for the clip 16 through the sheet 10, which might cause the clip to interfere with a weapon being inserted into or drawn from the holster.

By now, it is clear that the holster may be used with a wide variety of handguns. At first, one simply places the handgun in an open holster H, and then simply wraps ends 20 and 22 around the weapon to secure the hook 12 and loop 14 fasteners together, to have a resultant holster fitting the chosen handgun perfectly. This need only be done once for a chosen handgun. The open bottom 30 of the holster allows accommodates any reasonable handgun barrel length. The tapered side 34 allows the handgun trigger guard to pass into and through the top opening 28, but not through the relatively narrow bottom opening 30. It can be further appreciated that derringers, revolvers and semi-automatics may be holstered by this invention.

Figure 5B:
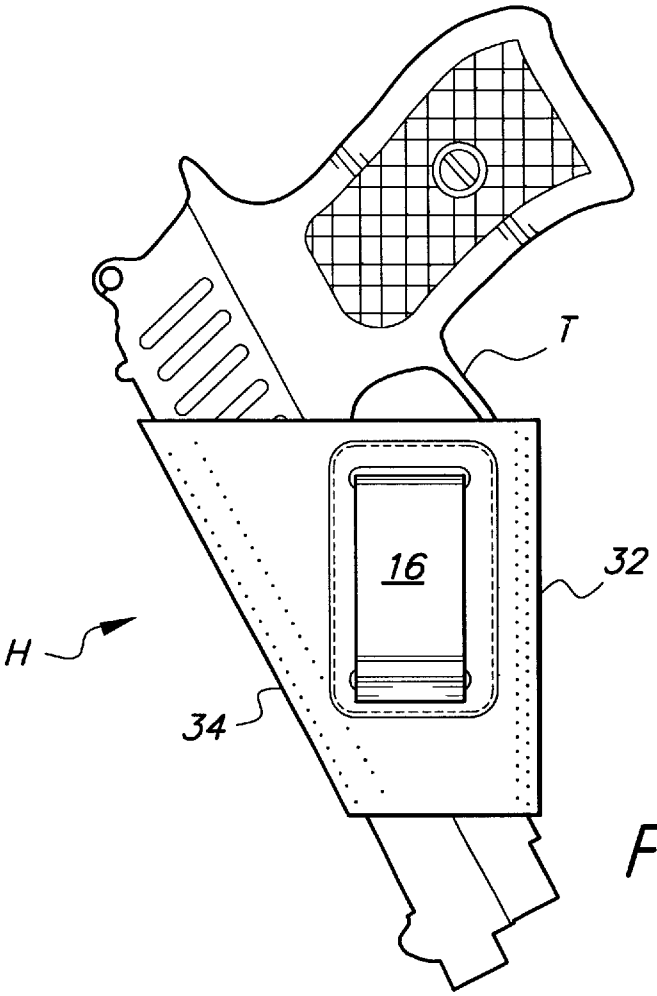
FIG. 5B is side view of a size-adjustable concealed carry holster according to the present invention, showing a gun carried in a grip-forward, muzzle-rearward orientation.
Figure 5A:
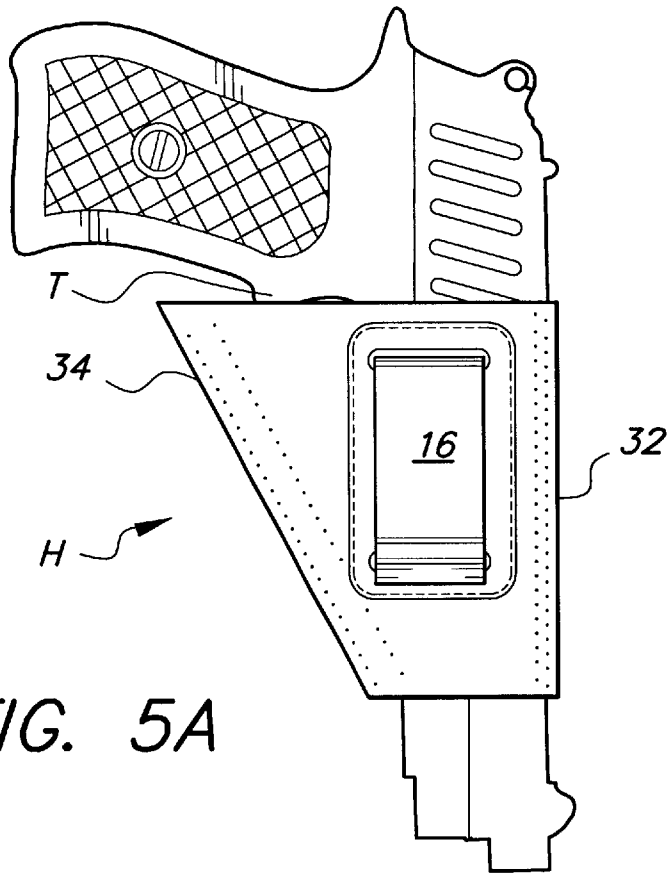
FIG. 5A is side view of a size-adjustable concealed carry holster according to the present invention, showing a gun carried in a muzzle-vertical orientation.

The holster may be worn on various places of the user's person, and is suitable for use by both left and right handed people. FIGS. 5A and 5B illustrate grip vertical and grip forward holstering, respectively. In FIG. 5A, the trigger guard T is inserted adjacent holster tapered side 34, and thus the handgun is carried vertically, so long as the clip 16 is attached vertically. When the handgun is inserted so that the drip T is adjacent the holster's vertical side 32, the handgun will be carried grip-forward. Of course, clipping the holster to a wearer's clothing at an angle will change the angle at which the handgun is carried.

Figure 6:
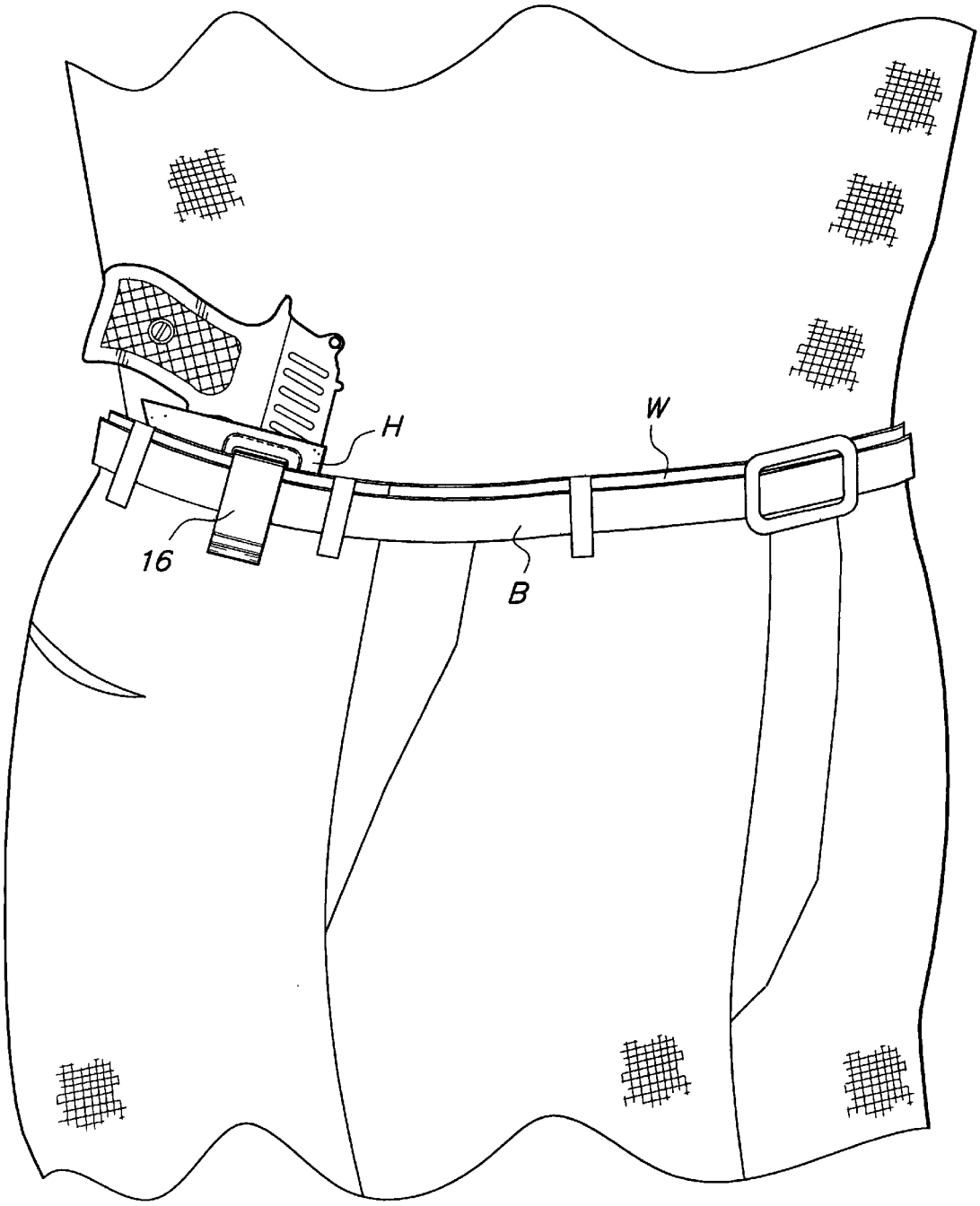
FIG. 6 is an environmental, perspective view of a size-adjustable concealed carry holster according to the present invention, showing the holster worn inside the wearer's waistband.
Figure 7:
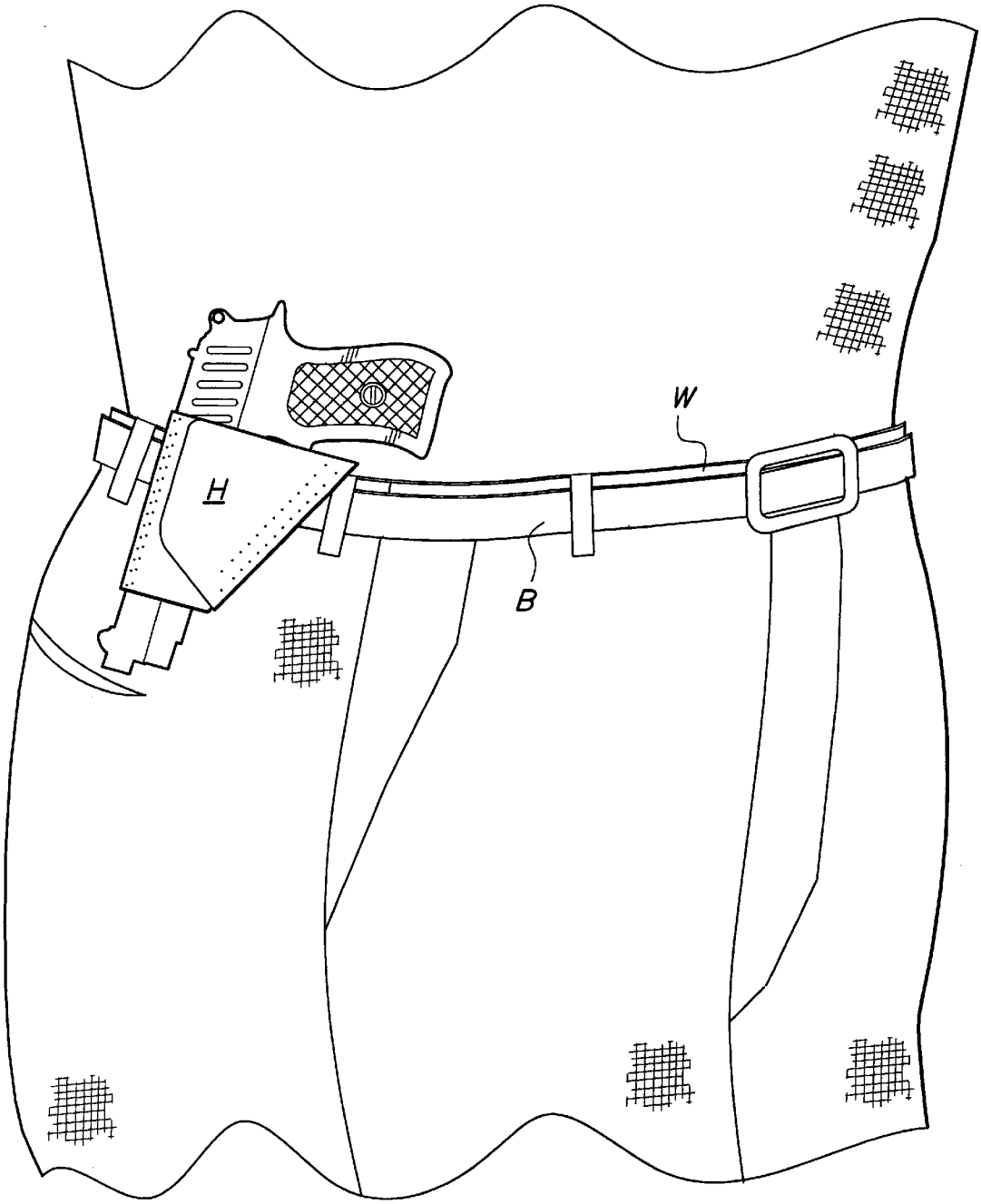
FIG. 7 is an environmental, perspective view of a size-adjustable concealed carry holster according to the present invention, showing the holster worn on the wearer's belt, in a crossdraw position.
Figure 8:
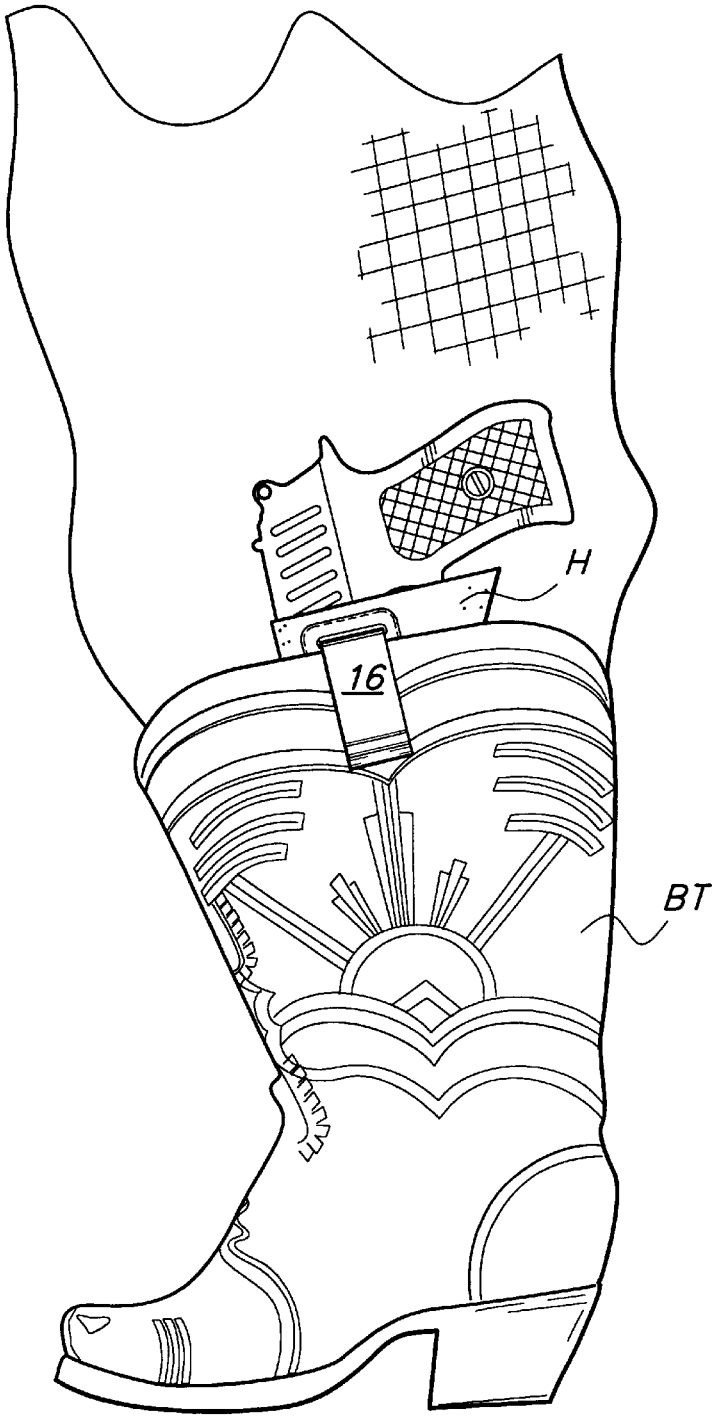
FIG. 8 is an environmental, perspective view of a size-adjustable concealed carry holster according to the present invention, showing the holster worn inside the wearer's boot.
Figure 9:
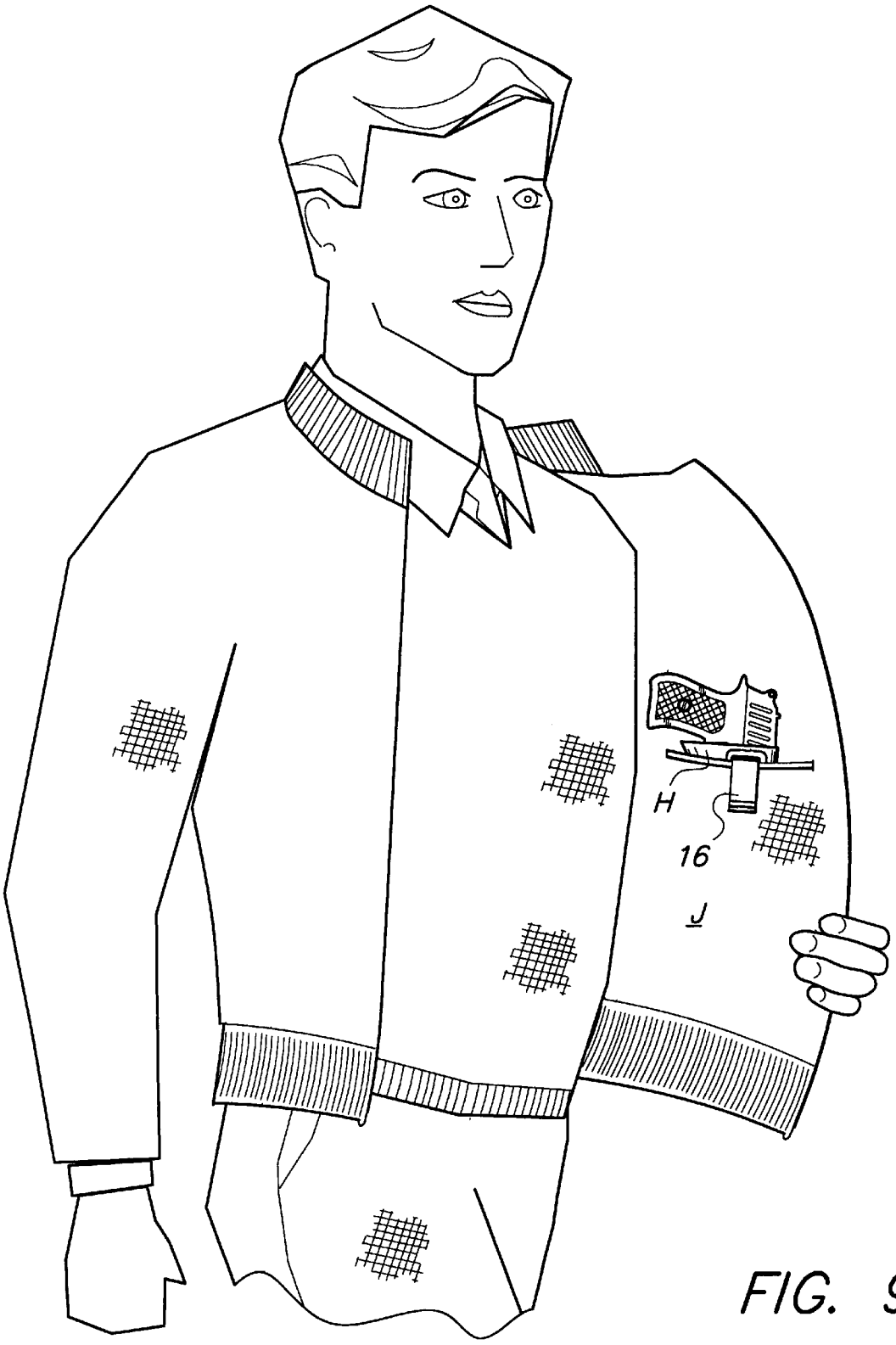
FIG. 9 is an environmental, perspective view of a size-adjustable concealed carry holster according to the present invention, showing the holster worn inside the wearer's inside jacket pocket.

FIGS. 6, 7, 8 and 9 are provided to indicate several of many ways the holster may be worn. As seen in FIG. 6, the holster is mounted in a preferred and suggested position, inside the wearer's waistband W, and clipped to a belt B, if worn. An advantage of this wearing of the invention is that the holster H may be worn securely even when the user is not wearing a belt. Conversely, as seen in FIG. 7, the holster H is shown being worn in a crossdraw position or attitude (it is assumed just for the purposes of this view that the wearer is left handed), with the holster outside of the waistband W and belt B. In FIG. 8, the holster H is shown clipped to the inside of a wearer's boot BT. Or, the wearer could elect to carry the handgun in the holster H clipped inside of the pocket of a jacket J, as depicted in FIG. 9.

Thus, it is understood that the present invention provides an easily used and worn holster that can accommodate a wide variety of handguns without any alteration of the holster at all, and that the holster may be worn in any one of a great number of positions an locations on one's person.

It is to be understood that the present invention is not limited to the embodiments described above, but encompasses any and all embodiments within the scope of the following claims.

I claim:

1. A size-adjustable holster, comprising:

a five-sided, elongated sheet dimensioned and configured so as to have a squared end and an opposed, eccentrically pointed end;

adjustably connected, mating fastener components on said squared end and eccentrically pointed end; and a clip attached to said sheet.

2. The size-adjustable holster according to claim 1, wherein said sheet is further dimensioned and configured to form a tapered pocket when said fastener components are interconnected.

3. The size-adjustable holster according to claim 2, wherein said tapered pocket has a wide open top end and a narrow open bottom end.

4. The size-adjustable holster according to claim 2, wherein said tapered pocket has a vertical side and an upwardly, outwardly, angled side.

5. The size-adjustable holster according to claim 1, wherein said mating fastener components are mating hook and loop fasteners.

6. The size-adjustable holster according to claim 1, wherein said clip is U-shaped, having a closed end and an open end.

7. The size-adjustable holster according to claim 6, wherein said open end includes opposing inward-curved bearing surface.

8. The size-adjustable holster according to claim 1, further comprising a clip securing panel.

9. The size-adjustable holster according to claim 8, wherein said clip securing panel includes a pair of horizontal slots.

10. The size-adjustable holster according to claim 9, wherein said clip is U-shaped, having a closed end and an open end.

11. The size-adjustable holster according to claim 10, wherein said open end includes opposing inward-curved bearing surfaces.

12. The size-adjustable holster according to claim 11, wherein said pair of horizontal slots of said clip securing panel correspond with said closed end of said clip and one of said pair of inward-curved bearing surfaces of said clip.

13. A size-adjustable holster, comprising:

a five-sided, elongated sheet dimensioned and configured so as to have a squared end and an opposed, pointed end;

adjustably connected, mating fastener components on said squared end and said pointed end, whereby the size of said holster may be adjusted; and a clip attached to said sheet.

14. The size-adjustable holster according to claim 13, wherein said mating fastener components are mating hook and loop fasteners.

15. The size-adjustable holster according to claim 13, further comprising a clip securing panel.

16. The size-adjustable holster according to claim 13, wherein said clip securing panel includes a pair of horizontal slots.

17. The size-adjustable holster according to claim 13, wherein said sheet is further dimensioned and configured to form a tapered pocket when said fastener components are interconnected.

18. The size-adjustable holster according to claim 17, wherein said tapered pocket has a wide open top end and a narrow open bottom end.

19. The size-adjustable holster according to claim 17, wherein said tapered pocket has a vertical side and an upwardly, outwardly, angled side.

* * * * *